US008945720B2

(12) United States Patent
Sreshta et al.

(10) Patent No.: US 8,945,720 B2
(45) Date of Patent: Feb. 3, 2015

(54) HARD COMPOSITE WITH DEFORMABLE CONSTITUENT AND METHOD OF APPLYING TO EARTH-ENGAGING TOOL

(75) Inventors: Harold Sreshta, Conroe, TX (US); Eric F Drake, Galveston, TX (US); Douglas B Caraway, Conroe, TX (US)

(73) Assignee: National Oilwell Varco, L.P., Houston, TX (US)

( * ) Notice: Subject to any disclaimer, the term of this patent is extended or adjusted under 35 U.S.C. 154(b) by 948 days.

(21) Appl. No.: 12/536,624

(22) Filed: Aug. 6, 2009

(65) Prior Publication Data

US 2011/0031028 A1 Feb. 10, 2011

(51) Int. Cl.

| | |
|---|---|
| ***B22F 7/00*** | (2006.01) |
| ***E21B 10/46*** | (2006.01) |
| ***C22C 19/07*** | (2006.01) |
| ***B22F 1/02*** | (2006.01) |
| ***B22F 7/08*** | (2006.01) |
| ***C22C 19/03*** | (2006.01) |
| ***C22C 26/00*** | (2006.01) |
| ***C22C 29/08*** | (2006.01) |
| *B22F 5/00* | (2006.01) |

(52) U.S. Cl.

CPC ..... *C22C 19/07* (2013.01); *B22F 1/025* (2013.01); *B22F 7/08* (2013.01); *C22C 19/03* (2013.01); *C22C 26/00* (2013.01); *C22C 29/08* (2013.01); *E21B 10/46* (2013.01); *B22F 2005/001* (2013.01); *B22F 2998/10* (2013.01); *C22C 2204/00* (2013.01)

USPC ..... 428/550; 175/425

(58) Field of Classification Search

None

See application file for complete search history.

(56) References Cited

U.S. PATENT DOCUMENTS

| | | | | |
|---|---|---|---|---|
| 2,992,900 | A | | 7/1961 | Bovenkerk |
| 3,141,746 | A | | 7/1964 | De Lai |
| 3,141,885 | A | | 7/1964 | Ross et al. |
| 3,148,161 | A | | 9/1964 | Bovenkerk et al. |
| 3,574,580 | A | | 4/1971 | Stromberg et al. |
| 3,744,982 | A | | 7/1973 | Bovenkerk et al. |
| 3,800,891 | A | * | 4/1974 | White et al. ..... 175/374 |
| 3,831,428 | A | | 8/1974 | Wentorf, Jr. et al. |
| 3,913,280 | A | | 10/1975 | Hall |
| 4,024,675 | A | * | 5/1977 | Naidich et al. ..... 51/296 |
| 4,224,380 | A | | 9/1980 | Bovenkerk et al. |
| 4,268,276 | A | | 5/1981 | Bovenkerk |
| 4,288,248 | A | | 9/1981 | Bovenkerk et al. |
| 4,368,788 | A | | 1/1983 | Drake ..... 175/374 |
| 4,372,404 | A | | 2/1983 | Drake ..... 175/374 |
| 4,398,952 | A | | 8/1983 | Drake ..... 419/18 |
| 4,534,773 | A | | 8/1985 | Phaal et al. |
| 4,554,130 | A | | 11/1985 | Ecer ..... 419/8 |
| 4,562,892 | A | | 1/1986 | Ecer ..... 175/371 |

(Continued)

FOREIGN PATENT DOCUMENTS

| | | |
|---|---|---|
| CA | 2423099 | 3/2002 |
| EP | 1190791 | 3/2002 |

(Continued)

*Primary Examiner* — Adam Krupicka

(74) *Attorney, Agent, or Firm* — JL Salazar Law Firm

(57) ABSTRACT

A hardmetal composite used as wear-resistant surfaces and inlays in earth-engaging equipment includes more than one hardphase. At least one hardphase has a high average particle size, for example, from 100 μm to 2000 μm. The hardphases vary in terms of particle size, hardness, and binder content, and at least one hardphase includes a particulate constituent capable of plastic deformation that comprises at least 1% residual porosity.

22 Claims, 4 Drawing Sheets

(56) References Cited

U.S. PATENT DOCUMENTS

| | | | | |
|---|---|---|---|---|
| 4,592,252 | A | 6/1986 | Ecer | 76/108 A |
| 4,630,692 | A | 12/1986 | Ecer | 175/330 |
| 4,726,432 | A * | 2/1988 | Scott et al. | 175/375 |
| 4,770,907 | A | 9/1988 | Kimura | 427/217 |
| 5,011,509 | A | 4/1991 | Frushour | |
| 5,011,514 | A | 4/1991 | Cho et al. | |
| 5,024,680 | A | 6/1991 | Chen et al. | 51/295 |
| 5,106,391 | A | 4/1992 | Lloyd | |
| 5,127,923 | A | 7/1992 | Bunting et al. | |
| 5,433,280 | A | 7/1995 | Smith | |
| 5,510,193 | A | 4/1996 | Cerutti et al. | |
| 5,544,550 | A | 8/1996 | Smith | |
| 5,645,617 | A | 7/1997 | Frushour | |
| 5,653,299 | A | 8/1997 | Sreshta et al. | 175/374 |
| 5,755,298 | A | 5/1998 | Langford, Jr. et al. | 175/374 |
| 5,776,615 | A | 7/1998 | Wong et al. | |
| 5,816,090 | A | 10/1998 | Hodge et al. | 72/56 |
| 5,839,329 | A | 11/1998 | Smith et al. | |
| 5,876,793 | A | 3/1999 | Sherman et al. | 427/213 |
| 5,880,382 | A * | 3/1999 | Fang et al. | 75/236 |
| 5,957,006 | A | 9/1999 | Smith | |
| 5,967,248 | A | 10/1999 | Drake et al. | 175/425 |
| 5,981,057 | A | 11/1999 | Collins | |
| 5,988,302 | A | 11/1999 | Sreshta et al. | 175/374 |
| 6,041,875 | A | 3/2000 | Rai et al. | |
| 6,045,440 | A | 4/2000 | Johnson et al. | |
| 6,045,750 | A | 4/2000 | Drake et al. | 419/6 |
| 6,063,333 | A | 5/2000 | Dennis | |
| 6,068,913 | A | 5/2000 | Cho et al. | |
| 6,193,001 | B1 | 2/2001 | Eyre et al. | |
| 6,200,514 | B1 | 3/2001 | Meister | |
| 6,209,420 | B1 | 4/2001 | Butcher et al. | |
| 6,238,280 | B1 | 5/2001 | Ritt et al. | 451/540 |
| 6,353,771 | B1 | 3/2002 | Southland | |
| 6,454,030 | B1 | 9/2002 | Findley et al. | |
| 6,544,308 | B2 | 4/2003 | Griffin et al. | |
| 6,601,662 | B2 | 8/2003 | Matthias et al. | |
| 6,655,481 | B2 | 12/2003 | Findley et al. | |
| 6,830,598 | B1 | 12/2004 | Sung | 51/307 |
| 6,852,414 | B1 | 2/2005 | Frushour | |
| 6,861,098 | B2 | 3/2005 | Griffin et al. | |
| 7,384,436 | B2 | 6/2008 | Sung | |
| 7,407,012 | B2 | 8/2008 | Keshavan et al. | |
| 7,435,478 | B2 | 10/2008 | Keshavan | |
| 7,475,743 | B2 | 1/2009 | Liang et al. | 175/374 |
| 7,493,973 | B2 | 2/2009 | Keshavan et al. | |
| 7,533,740 | B2 | 5/2009 | Zhang et al. | |
| 7,588,108 | B2 | 9/2009 | Miyao | |
| 7,862,634 | B2 | 1/2011 | Belnap et al. | |
| 7,862,932 | B2 | 1/2011 | Eguchi et al. | |
| 7,963,348 | B2 | 6/2011 | Laird et al. | |
| 7,972,409 | B2 | 7/2011 | Fujino et al. | |
| 2005/0044800 | A1 | 3/2005 | Hall et al. | |
| 2005/0109545 | A1 * | 5/2005 | Lockwood et al. | 175/374 |
| 2005/0115744 | A1 | 6/2005 | Griffin et al. | |
| 2006/0060391 | A1 | 3/2006 | Eyre et al. | |
| 2006/0060392 | A1 | 3/2006 | Eyre | |
| 2006/0165993 | A1 | 7/2006 | Keshavan | |
| 2006/0191723 | A1 | 8/2006 | Keshavan | |
| 2006/0207802 | A1 | 9/2006 | Zhang et al. | |
| 2006/0266559 | A1 | 11/2006 | Keshavan et al. | |
| 2007/0039762 | A1 | 2/2007 | Achilles | |
| 2007/0277651 | A1 | 12/2007 | Calnan et al. | |
| 2008/0028891 | A1 | 2/2008 | Calnan et al. | |
| 2008/0142275 | A1 | 6/2008 | Griffin et al. | |
| 2008/0149397 | A1 * | 6/2008 | Overstreet | 175/374 |
| 2009/0166094 | A1 | 7/2009 | Keshavan et al. | |
| 2009/0173015 | A1 | 7/2009 | Keshavan et al. | |
| 2011/0212303 | A1 | 9/2011 | Fuller et al. | |

FOREIGN PATENT DOCUMENTS

| | | |
|---|---|---|
| GB | 2433525 | 6/2007 |
| GB | 2451951 | 2/2009 |
| GB | 2453435 | 4/2009 |
| GB | 2455425 | 6/2009 |
| GB | 2467570 | 8/2010 |
| UA | 74010 | 7/2003 |
| WO | 0224601 | 3/2002 |
| WO | 0224603 | 3/2002 |

* cited by examiner

Packed Powder

CIPed Powder

Forged Powder

HARD COMPOSITE WITH DEFORMABLE CONSTITUENT AND METHOD OF APPLYING TO EARTH-ENGAGING TOOL

CROSS-REFERENCE TO RELATED APPLICATIONS

Not applicable.

FIELD

The present invention generally relates to hardmetal composites used as wear-resistant inlays and surfaces in earth-contacting tools and a method for their application.

BACKGROUND

Hardmetal composites inlays and hardfacings are used as cutting edges and wear surfaces in drill bits and other earth-engaging equipment. Hardmetal composites generally consist of a hardmetal such as tungsten carbide, diamond, cubic boron nitride, or ceramic dispersed in a softer, metal matrix, optionally including a binder metal as well.

Tungsten carbide (or carbide) is a hardmetal frequently chosen for hardfacing abrasive and cutting surfaces on drill bits. Enhanced performance can be achieved with high carbide loading (high volume fraction) and large constituent particles. At higher carbide volume fraction and greater particle sizes, hardness is increased. However, during forge densification, the carbide particles are more likely to come into contact with one another, creating increased porosity and forming bridges susceptible to cracking and particle fracture. Composites that include carbide particles with lower hardness and/or smaller particle size can increase the loading threshold for these defects, but with attendant sacrifice in wear performance.

Designs that increase abrasiveness, such as high hardphase volume fraction and large particle size, often suffer lack of resistance to impact. Thus, there seems to be an inherent trade-off between hardness and toughness in the manufacture of hardfacing materials, limiting levels of achievable hardphase volume fractions. Prior art suggests that carbide hard phase volume fractions cannot exceed about 40 vol % to 60 vol %, without suffering the attendant defects just described.

Prior art solutions that have most nearly achieved high hardphase volume fractions while maintaining impact resistance have addressed the influence of matrix microstructure on deformation mechanics of hard composites affecting toughness and wear progressions in drilling service. U.S. Pat. No. 6,045,750 discloses a powder-forging method producing hard composite coatings that achieve sintered cemented carbide loading values over about 75 vol %. However, these coatings are rough and limited in thickness to about 3× particle diameter. For thicker hard composites, full-density powder forge fabrication is limited to formulations with hardphase volume fractions of 45 vol % or less, depending on forging pressure and temperature.

Thus, a need exists for hard metal composites to be used as cutting edges and wear surfaces in drill bits and other earth-engaging equipment, which composites achieve high particle size and a hardphase volume fraction higher than prior art achievement, without sacrificing toughness.

SUMMARY

Embodiments of the present invention generally include a hardmetal composite that is used as hardsurfacings and inlays in earth-engaging equipment.

In one embodiment, the invention is for a hardmetal composite that achieves large hardmetal particle size and high hardphase volume fraction while maintaining toughness. The hardmetal composite has more than one hardphase, with a bi-modal or multi-modal particle size distribution.

In an embodiment, the primary hardphase includes hardmetal particles from 100 to 2000 μm, optionally from 250 to 1000 μm, or optionally from 400 to 800 μm in size. In an embodiment, at least one of the additional hardphases includes a particulate constituent capable of plastic deformation that has at least 1% residual porosity. This hardphase can also include a small particle size, high binder content, and/or a low hardness, relative to the primary hardphase.

In an embodiment, the hardmetal composite includes a malleable matrix material, such as a steel matrix consisting essentially of iron powder with an average particle size of less than 20 μm. In an embodiment, the matrix material further serves as a malleable shell, encapsulating individual hardmetal particles.

In general, the hardmetal is carbide, but can also be chosen from among other hardmetals, such as diamond, cubic boron nitride, and ceramic.

In one embodiment, the hardmetal composite includes three hardphases and a total hardphase volume fraction of greater than 60%. The primary hardphase includes an average particle size of from 100 to 2000 μm, a hardness from 900 to 1200 VHN, and 10 to 20 wt % of a Co binder. The secondary hardphase includes an average particle size from 50 to 300 μm, a hardness of from 1400 to 1800 VHN, and from 3 to 20 wt % of a Co binder. The tertiary hardphase includes a particulate constituent with at least 1% residual porosity, an average particle size of from 10 to 60 μm, a hardness of from 800 to 1200 VHN, and a 10 to 25 wt % of a Ni binder.

In one embodiment, the hardmetal composite includes two hardphases and a total hardphase volume fraction of greater than 70%. The primary hardphase includes an average particle size of from 100 to 2000 μm, a hardness of from 900 to 1800 VHN, and from 3 to 16 wt % of a Co binder. The secondary hardphase includes a particulate constituent with at least 5% residual porosity, an average particle size of from 10 to 60 μm, a hardness of from 800 to 1400 VHN, and from 10 to 25 wt % of a Ni binder.

In one embodiment, the invention is for an earth-engaging tool that employs hardsurfacing made up of multiple carbide hardphases, varying in particle size, binder content, and hardness, wherein at least one hardphase includes a deformable constituent with at least 1% residual porosity. The hardsurfacing includes large carbide particle size and at least 60%, optionally 70%, hardphase volume fraction.

In one embodiment, the invention is a method for forming a hardmetal composite and applying said composite to a substrate. The method includes selecting one or more hardphases made up of hardmetal particles, encapsulating the hardmetal particles in shells of malleable matrix material, applying the encapsulated particles to a substrate, and finishing the substrate by forging.

In an embodiment, the hardphases display bi-modal or multi-modal particle size distribution. In an embodiment, the hardphase volume fraction exceeds 50%, with at least one hardphase having from 100 μm to 2000 μm average particle size. In an embodiment, at least one hardphase includes a particulate constituent capable of plastic deformation that includes at least 1% residual porosity. In an embodiment, the malleable matrix material makes up from 5 to 60 vol %, optionally from 10 to 40 vol %, of the encapsulated particles. In an embodiment, the substrate is an earth-engaging tool, such as a drill bit. The step of finishing the substrate can include cold isostatic pressing, heating, and forging.

DETAILED DESCRIPTION

Figure 1A:
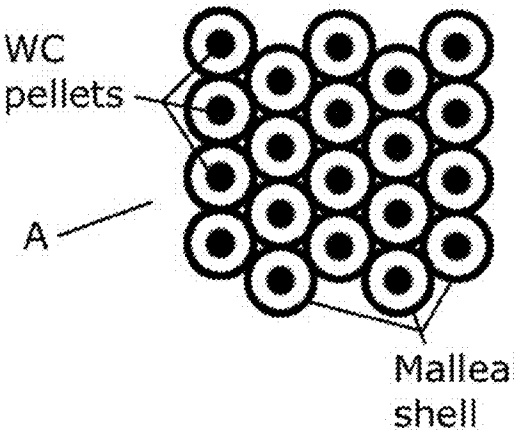
FIG. 1*a-c* shows a drawing of a hardmetal composite, in which hardmetal particles are encapsulated in a malleable matrix material, followed by cold isostatic pressing and forging.

The present invention in its many embodiments is generally for a hardmetal composite with large particle size and high hardphase volume fraction. Generally, the composite has at least one particulate constituent capable of plastic deformation, and the composite displays bi-modal or multi-modal particle size distribution. Furthermore, in one embodiment the composite includes a matrix that can at least partially be present in the form of malleable shells encapsulating hardphase particles.

In one embodiment, the hardmetal composite has at least one particulate constituent of a composition and size and having residual porosity at a level and size that undergoes preferential-plastic deformation and densification at forging temperature under local conditions of elevated pressure associated with particle contacts. Such constituent is distinct from the main hardmetal constituent, also known as the primary hardphase. When compared to the main hardmetal constituent, the particulate constituent of the present embodiment generally has at least one of the following characteristics: relatively small size, relatively low hardness, relatively high residual porosity, and relatively high binder content. For example, the particulate constituent can have an average particle size ranging from 1 μm to 300 μm, optionally from 5 μm to 100 μm, optionally from 15 μm to 60 μm. The particulate constituent can have a hardness number less then 1500 VHN, optionally less than 1100 VHN. The particulate constituent can have a residual porosity between 0.2% and 50%, optionally between 10% and 40%. The particulate constituent can have a binder (Ni, Co, Ni+Co, Fe+Ni+Co) content greater than 10 wt %, optionally between 10 wt % and 50 wt %. The relatively small particle size can increase packing density and the relatively low hardness can provide plastic accommodation of densification strains in some of the hardphase as well as the matrix metal. The higher binder content combined with residual porosity of the pellets allows more plastic deformation and differential densification sensitive to local stress conditions. The particulate constituent is generally a hardmetal, such as tungsten carbide (or carbide), diamond, cubic boron nitride, ceramic, or the like. The hardmetal can readily be chosen by one skilled in the art, according to design specifications. In one embodiment, the particulate constituent is a sintered cemented carbide. The hardmetal composite can contain one, or optionally more than one, of the particulate constituents.

In an embodiment, the hardmetal composite has bi-modal or multi-modal distribution of its particle sizes. Such can be the case in the previous embodiment, when the at least one particulate constituent has a size significantly different from the main hardmetal constituent. As large hardmetal particulates are desirable for enhanced performance in wear surfaces, the main hardmetal constituent (or primary hardphase) can have an average particle size from 100 μm to 2000 μm, optionally from 250 μm to 1000 μm, optionally from 400 μm to 800 μm. The other phase (or phases) can have distinct particle size ranges. A bi-modal or multi-modal distribution of particle sizes can enhance the packing density of the hard metal composite and can prevent undesirable bringing of hardmetal particles.

In an embodiment, the hardmetal composite has a steel matrix having iron powder with a particle size less then 50 μm, and optionally less then 10 μm. The steel matrix can have a relatively low particle size and relatively low hardness when compared to the hardphase, which characteristics can provide benefits such as plastic deformation, increasing the composite's toughness. The benefits imparted by the steel matrix can be enhanced when one of the hardmetal phases has a particulate constituent with a particle size from about 5 μm to 100 μm. The steel matrix can have from 10 vol % to 50 vol % of the hardmetal composite, optionally from 20 vol % to 40 vol %.

In an embodiment, the hardmetal composite includes at least one constituent with a cobalt binder, at least one constituent with a nickel binder, and an iron matrix. Such an arrangement can lead to the formation of tempered martensite halos around the cobalt binder phase(s), due to nickel and cobalt diffusion and alloying of the surrounding iron matrix. As a result, the matrix can be strengthened and the hardmetal composite microstructure can exhibit increased resistance to the shear localization failure and wear progression.

In an embodiment, the particles of the hardphase(s) are encapsulated in a malleable shell. Such encapsulation can eliminate the need for powder preforms, and thus, can also eliminate the need for expensive, custom-made molds. Hardmetal components used in earth-engaging tools are generally made from preformed components, which are produced using injection-molding equipment, molds and drying fixtures specific to each component and a drying oven. It is generally expensive and time-consuming to produce the molds, and each time design changes are made, new tooling must be created. Thus, eliminating the need for preforms can reduce costs and allow for greater design flexibility.

According to this embodiment, hardmetal material in a powder, pellet, and/or granular form is encapsulated in a more malleable material such as steel, iron, brass, bronze, nickel, alumina, or the like. The method of encapsulation can be any known in the art, such as electro-plating, chemical plating, vacuum deposition, chemical vapor deposition, metal vapor deposition, and the like. The encapsulated pellets can then be placed in a single layer, multiple layers, and/or specific locations in a mold for cold isostatic pressing (CIP). The CIPed part can be around 80% dense, and after heating and forging, the part can have a density of or nearly of 100%. The malleable matrix volume can be from 5% to 60%, optionally from 10% to 40%, of the encapsulated particle.

A further advantage of using encapsulated material for the hardphase is that the hardphase particles are prevented from contacting one another, while the soft, malleable material fills the voids created by packing spherical objects. As a result, bridging between hardmetal particles and folds and laps in the forged part can be prevented, increasing the hardmetal composite's performance and wear resistance. In an embodiment, the hardphase(s) includes carbide particles encapsulated in steel matrix material.

Figure 1B:
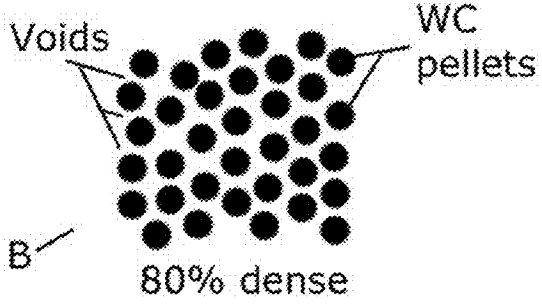
Figure 1C:
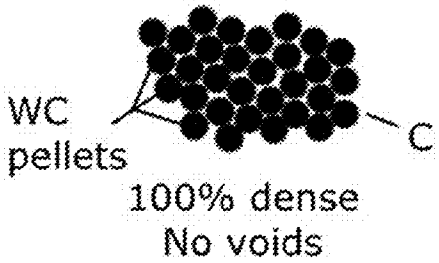

FIG. 1*a-c* is a drawing that represents what takes place when encapsulated hard metal particles are applied to the surface of a tool or other substrate via CIPing and forging.

FIG. 1*a* shows carbide pellets encapsulated in a malleable material. The malleable material can be any malleable metal, and the pellets can be any hardmetal. Although the pellets are shown as carbide pellets in the drawing, the pellets need not be carbide. FIG. 1*b* shows the composite after CIPing. The malleable shells are deformed and fill the space between the carbide pellets, with some amount of voids. At this point, the metal composite is about 80% dense. FIG. 1*c* shows the composite after forging. At this point, the malleable material completely fills the spaces between the carbide pellets, and the composite is nearly 100% dense without damage to the hard metal particles.

In general, the hardmetal composite can include any hardmetal known in the art and useful as components and hardsurfacings in earth-engaging equipment. Known hardmetals include tungsten carbide, diamond, cubic boron nitride, and ceramic, among others. Useful carbides include WC, $W_2C$, the $WC/W_2C$ eutectic, and carbide composites. These hardmetals make up the hardphase of the hard metal composite. The hardphase volume fraction can be above 50%, optionally above 60%, optionally above 70%, optionally above 80%, optionally above 90%. Except in embodiments specifically requiring a steel matrix, the matrix material can be any known in the art in the manufacture of hardmetal composites. The matrix volume fraction can be less than 50%, optionally less than 40%, optionally less then 30%, optionally less than 20%, optionally less than 10%.

The hardmetal composite can be used for components and hard surfacing in any metal tool wherein resistance to wear and abrasion is desired. Earth-engaging equipment are one class of tools eligible for the hardmetal composite of the present invention and include such tools as reamers, underreamers, hole openers, stabilizers and shock absorber assemblies, saws, picks, chisels, plows, and fluid flow control equipment. The present invention is particularly suited for abrasive surface and cutting elements in drill bits, such as roller cone drill bits, fixed cutter drill bits, rotary cone bits, drag bits, mill tooth bits, cutters on drill bits, and other parts of the drill bit assembly, including the core, nozzle, centralizer, and stabilizer sleeve. The invention can also be used for highly erosive applications such as SAGD (Steam Assisted Gravity Drainage), an enhanced oil recovery technology for producing heavy crude oil and bitumen. In one embodiment, the present invention is for an earth-engaging tool that employs hardsurfacing made up of multiple carbide hardphases, varying in particle size, binder content, and hardness, wherein at least one hardphase includes a deformable constituent with at least 1% residual porosity, optionally at least 5%, optionally at least 10%, optionally at least 15%, optionally at least 20%, optionally at least 25%, optionally at least 50%. The hardsurfacing includes large carbide particle size and at least 60%, optionally at least 70%, hardphase volume fraction. The hard surfacing can cover or be used as an inlay or an integral component for any section of the tool. In drill bits, the hardsurfacing can be used as wear-resistant cover or inlay for the teeth or other area experiencing abrasion, such as surfaces near hydraulic courses. The hardsurfacing can be applied with a thickness of from 0.010" to 1.0", optionally in the range of 0.125" to 0.375". Since multiple hardmetal composite formulas fall within the scope of the present invention, different formulas can be used for different areas of the tool. Different formulas can be used in the same area of the tool, present in a layered fashion.

Except in embodiments involving encapsulated hardmetal, the hardmetal composite can be formed and applied to the chosen substrate by any method known in the art, including such procedures as spraying, welding, molding, forging, densification, heating, etc. In an embodiment, the hardmetal composite is produced as a preform via powder forging and is then applied to the chosen substrate.

In one embodiment, the present invention is a method for applying a component having a hardmetal composite to a substrate to increase the substrate resistance to wear and abrasion. The method includes the steps of selecting one or more hardphases including a hardmetal, encapsulating particles of said one or more hardphases in a malleable matrix material, applying the desired amount encapsulated particles to the surface of the substrate, and finishing the substrate with cold isostatic pressing, heating, and forging. The substrate can be an earth-engaging tool, such as a drill bit. The hardmetal of the one or more hardphases can be tungsten carbide. The one or more hardphases can include at least two hardphases, which contain tungsten carbide and optional binders. The at least two hardphases can include a bi-modal or multimodal particle size distribution and varying hardness. At least one of the hardphases can include a particulate constituent with one or more of the following characteristics: a relatively small size, a relatively low hardness, relatively high residual porosity, and relatively high binder content, when compared to the primary hardphase. The malleable matrix material can include steel including iron or Nickel powder with a particle size less then 20 μm, and the encapsulation method can be any known in the art.

The following examples are meant to provide a greater understanding of the present invention but are embodiments only and are not intended to be limiting in any way.

Example A

A hardmetal composite was formed having three hardphases and a steel matrix. The three hardphases are herein referred to as the primary, secondary, and tertiary hardphase. The total hardphase volume fraction was 65 vol % (77 wt % Carbide).

The primary hardphase made up 45 vol % of the densified hardmetal composite and included 16/20 Mesh, 1100 VHN WC-Co sintered cemented carbide pellets. The pellets ranged in size from 850 μm to 1000 μm with an average particle size of 925 μm. The primary hardphase contained 14.8 wt % of a cobalt binder. The relatively high binder content, lower hardness, and increased toughness of this particulate constituent can allow greater plastic deformation of pellets, reducing the propensity of bridging cracks and bridging porosity in the matrix.

The secondary hardphase made up 6.0 vol % of the densified hardmetal composite and included 60/200 Mesh, 1625 VHN WC-Co sintered cemented carbide pellets. The pellets ranged in size from 75 μm to 250 μm with an average particle size of 162 μm. The secondary hardphase contained 6.0 wt % of a cobalt binder. The smaller size range can increase packing efficiency and decrease bridging potential, while higher hardness can imparts wear resistance.

The tertiary hardphase made up 14 vol % of the densified hardmetal composite and included 270/635 Mesh, 1050 VHN, WC-Ni sintered cemented carbide pellets with 25 vol % residual porosity. The pellets ranged in size from 20 μm to 53 μm with an average particle size of 37 μm. The tertiary hardphase contained 17.0 wt % of a nickel binder. The higher binder content combined with residual porosity of the pellets can allow for more plastic deformation and differential densification sensitive to local stress conditions. Full closure of porosity at bridging locations is accompanied by high deformation ratios, resulting in a highly loaded composite with low incidence of large voids and bridging cracks. The fine scale of the tertiary hard phase having commercial thermal spray powder and even finer scale of its end-residual porosity serve to increase rather than reduce toughness of the densified composite hardmetal.

The steel matrix made up 35 vol % of the hardmetal composite and included carbonyl iron powder with 0.05 wt % carbon max (BASF CS Carbonyl Iron Powder). The particle size ranged from 2 μm to 9 μm, with an average particle size of 4 μm. The combination of this chemistry with diffusional transport of cobalt and tungsten from primary and secondary sintered pellets and nickel from the tertiary hardphase created martensitic transformation halos around the primary and secondary hardphases, strengthening the densified matrix and increasing wear resistance while retaining substantial toughness.

The following table summarizes the composition of the hardmetal composite of Example A.

TABLE 1

Hardmetal composite of Example A.

| VOL % IN INLAY | PELLET SIZE, μ AV. | RANGE | WT % Co | VHN |
|---|---|---|---|---|
| PRIMARY HARDPHASE | | | | |
| 45.0 | 925 | 850-1000 | 14.8 | 1100 |
| SECONDARY HARDPHASE | | | | |
| 6.0 | 162 | 75-250 | 6.0 | 1625 |
| VOL % IN INLAY | PELLET SIZE, μ AV. | RANGE | WT % Ni | VHN |
| TERTIARY HARDPHASE | | | | |
| 14.0 | 37 | 20-53 | 17.0 | 1050 |
| VOL % IN INLAY | PELLET SIZE, μ AV. | RANGE | WT % Ni | VHN (avg.) |
| MATRIX | | | | |
| 35.0 | 4 | 2-9 | 0 | 500 |

Figure 2:
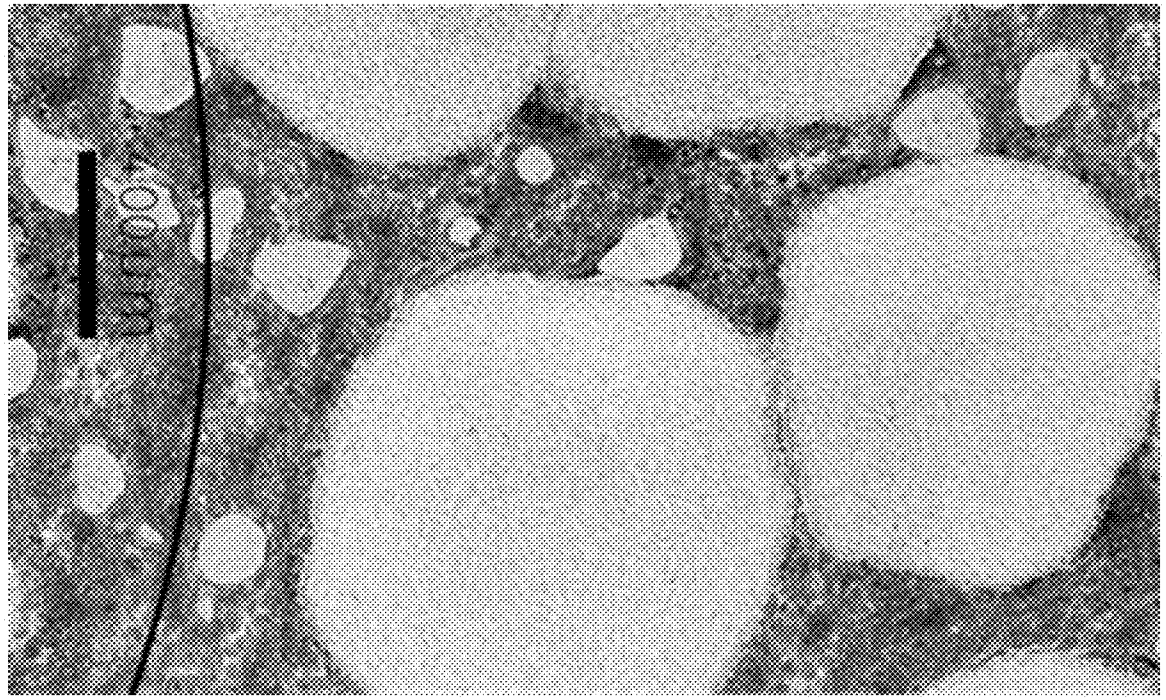
FIG. 2 is a microscopic photo of the hardmetal composite described in Example A.

The hard metal composite was used in the drill bit described in Example C, as well as on the inner row teeth of the drill bits described in Examples E, F, and G. A microscopic photo of the hardmetal composite is shown in FIG. 2. This photo shows the trimodal particle size distribution of the hardphase, as well as the absence of bridging porosity at contact points between the primary hardphase. The photo also shows uniform distribution of the tertiary, deformable, hardphase with reduced porosity, and some desirable deformation induced shape changes in the tertiary hardphase.

Example B

A hardmetal composite was formed having two hardphases and a steel matrix. The two hardphases are herein referred to as the primary and the secondary hardphase. The total hardphase volume fraction was 75 vol % (85 wt %).

The primary hardphase made up 52.5 vol % of the densified hardmetal composite and included 40/60 Mesh, 1625 VHN WC-Co sintered cemented carbide pellets. The pellets ranged in size from 250 μm to 425 μm with an average particle size of 338 μm. The primary hardphase contained 6.0 wt % of a cobalt binder. The smaller size range can increase packing efficiency and decrease bridging potential, while the higher hardness can impart wear resistance.

The secondary hardphase made up 22.5 vol % of the densified hardmetal composite and included 270/635 Mesh, 1050 VHN WC-Ni sintered cemented carbide pellets with 25 vol % residual porosity. The pellets ranged in size from 20 μm to 53 μm with an average particle size of 37 μm. The secondary hardphase contained 17.0 wt % of a nickel binder.

The steel matrix made up 25 vol % of the hardmetal composite and included carbonyl iron powder with 0.05 wt % carbon max (BASF CS Carbonyl iron Powder). The particle size ranged from 2 μm to 9 μm, with an average particle size of 4 μm. The combination of this chemistry with diffusional transport of cobalt and tungsten from primary phase sintered pellets and nickel from the secondary hardphase created martensitic transformation halos around the primary hardphase, strengthening the densified matrix and increasing wear resistance while retaining substantial toughness.

The following table summarizes the composition of the hardmetal composite of Example B.

TABLE 2

Hardmetal composite of Example B.

| VOL % IN INLAY | PELLET SIZE, μ AV. | RANGE | WT % Co | VHN |
|---|---|---|---|---|
| PRIMARY HARDPHASE | | | | |
| 52.5 | 338 | 250-425 | 6.0 | 1625 |
| VOL % IN INLAY | PELLET SIZE, μ AV. | RANGE | WT % Ni | VHN |
| SECONDARY HARDPHASE | | | | |
| 22.5 | 37 | 20-53 | 17.0 | 1050 |
| VOL % IN INLAY | PELLET SIZE, μ AV. | RANGE | WT % Ni | VHN (avg.) |
| MATRIX | | | | |
| 25.0 | 4 | 2-9 | 0 | 500 |

Figure 3:
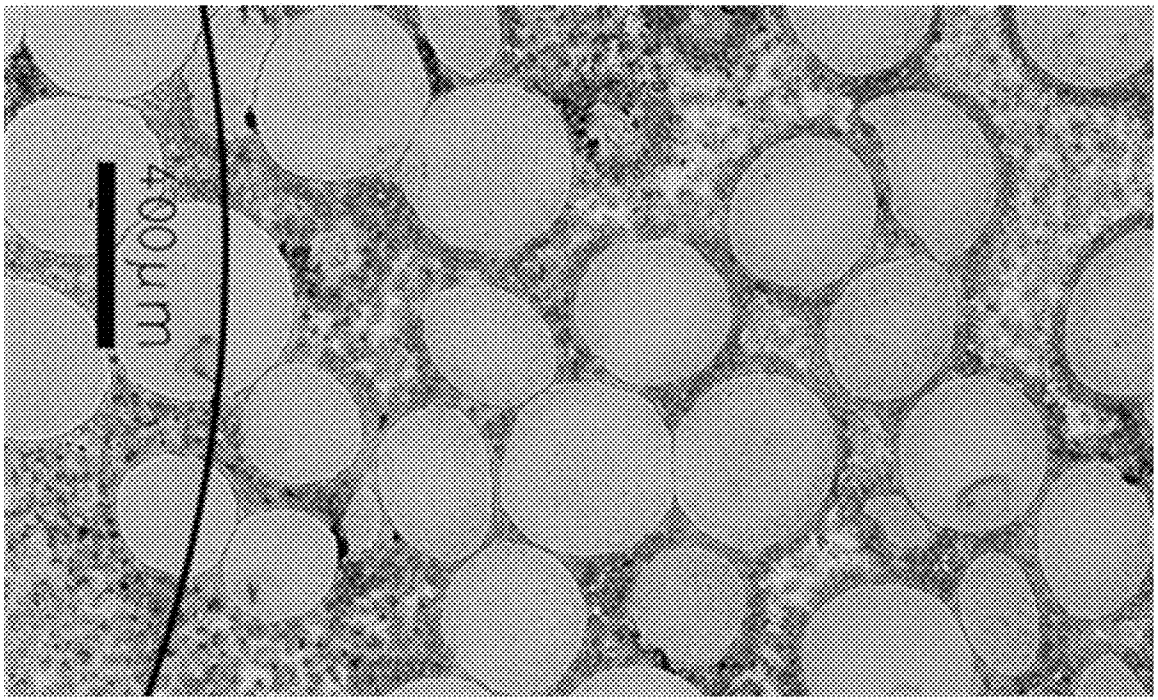
FIG. 3 is a microscopic photo of the hardmetal composite described in Example B.

The hardmetal composite was used in the drill bit described in Example C, as well as on teeth in the drill bits described in Examples D, E, F, G, and H. A microscopic photo of the hard metal composite is shown in FIG. 3. The photo shows bimodal particle size distribution of the hardphase, as well as the absence of bridging porosity at contact points between the primary hardphase. The photo also shows uniform distribution of the secondary, or deformable, hardphase with reduced porosity, and some desirable deformation induced shape changes in the tertiary hardphase.

Example C

Figure 4:
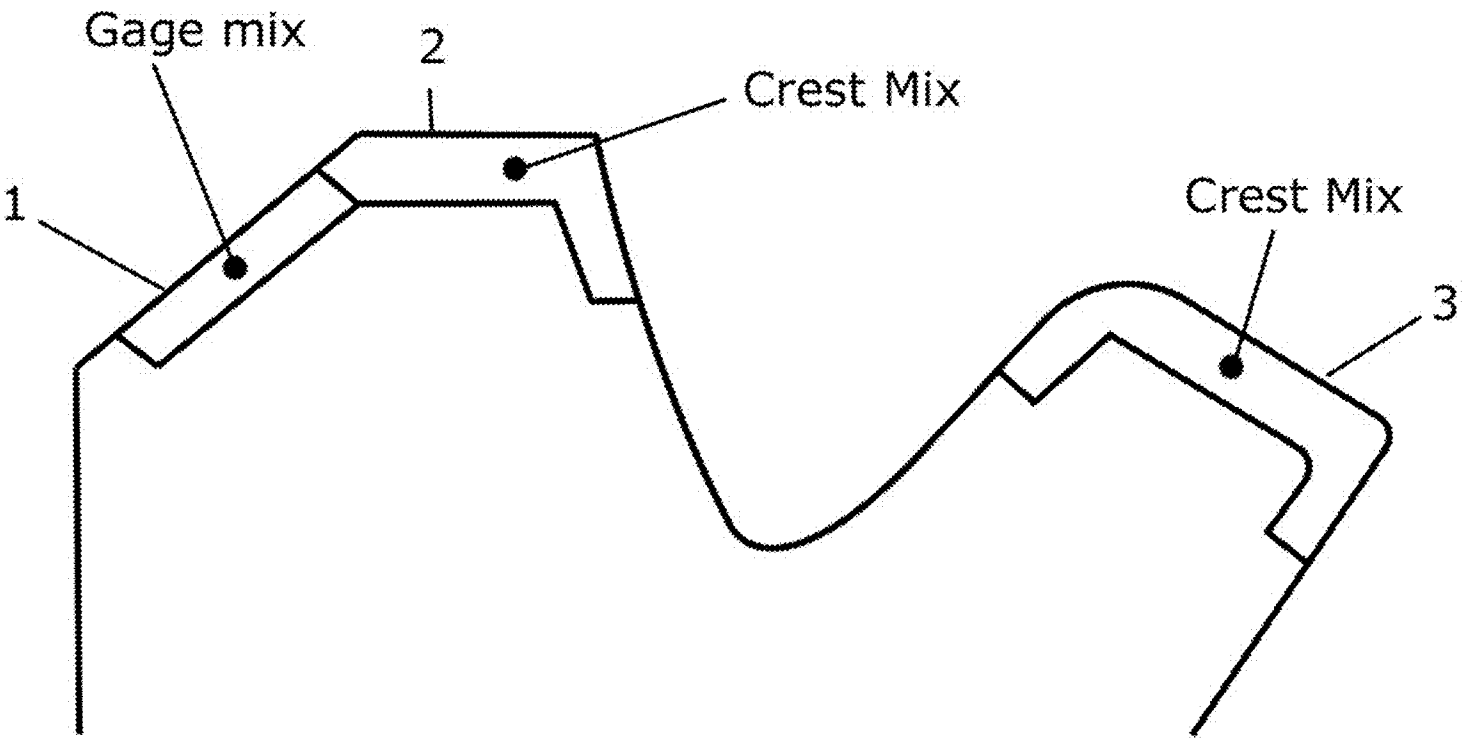
FIG. 4 is a schematic drawing showing the placement of hardmetal composites of the surface of the drill bit described in Example C.

The hardmetal composites of Examples A and B were used to make MIM (Metal Injection Molded) caps on the cutting structure of a 12¼" drill bit. The hardmetal composite of Example A, the composite with a hardphase volume fraction of 65%, can be referred to as the "crest mix". The hardmetal composite of Example B, the composite with a hardphase volume fraction of 75%, can be referred to as the "gage mix". FIG. 4 is a schematic of the hardmetal protection placement on the bits. The gage mix covers the gage teeth's tang (or gage row heel surfaces) 1, and the crest mix covers the crest of gage 2, as well as the inner and main row teeth 3. All tooth crests have a substantially uniform 0.220" thick hardmetal cover.

The drill bits were tested in Texas, Alaska, Louisiana, and Canada. The data for the bit runs is shown in Table 3.

TABLE 3

| Serial # | Run Location | Feet Drilled | Hours | ROP (ft/hr) | # Bit Runs |
|---|---|---|---|---|---|
| K41339 | Newton Cty. TX | 3994 | 102.5 | 39 | 1 |
| K41340 | Liberty Cty. TX | 1523 | 102.0 | 14.9 | 1 |
| K41341 | Liberty Cty. TX | 3605 | 101.5 | 35.5 | 1 |
| K41342 | Upshur Cty. TX | 281 | 23.0 | 12.2 | 1 |
| K41343 | Harrison/ Freestone Cty. TX | 3505 | 36.5 | 96 | 2 |
| W24217 | Prudhoe Bay AK | 3033 | 11.5 | 264 | 2 |
| W24220 | Alberta (SAGD) Canada | 1339 | 15.0 | 89.2 | 1 |
| A73408 | Vermilion Parish LA | 4973 | 93.5 | 53.2 | 1 |
| A73410 | Vermilion Parish LA | 1971 | 83.0 | 23.7 | 1 |
| A73409 | Vermilion Parish LA | 1173 | 87.0 | 13.5 | 1 |
| A73411 | Vermilion Parish LA | 304 | 39.5 | 7.7 | 1 |

In Texas, five bits were sent to the field with 6 runs and no bearing failures. The lithology consisted of cross-bedded sandstone, sandy shale, clay and mudstone. Bit (s/n K41339) drilled 3994 feet in 102.5 hours in a directional well on a motor. The bit finished with 1,125 k-revolutions, a 191.4% increase over the offset average. Bit (s/n K41340) drilled 1523 feet in 102 hours in a vertical well with significant wear in the inner rows and slight gage rounding approximately ¼" off of gage. The ROP was lower than the offsets because one of the pumps was down. Also, there was no center jet in the bit. Bit (s/n K41341) drilled 3605 feet in 101.5 hours, 49% more hours than average offsets, in a vertical well. The nose experienced heavy erosion from the center jet nozzle as well as significant wear on the inner rows. The ROP was low again for the same reasons stated above. The other three runs were short and successful, approximately 20 hours, with high rates of penetration.

In Alaska, the lithology consisted of permafrost and mudstone. Bit (s/n W24217) drilled 1466 feet in 4.9 hours and had an ROP of 299 ft/hr in a directional well on a motor. The same bit was re-run a month later and drilled 1567 feet in 6.6 hours. The cutting structure had worn teeth, slight erosion along with some gage rounding.

In Louisiana, all runs were on directional wells with a motor in the same well and the lithology was "gumbo" which consists of mostly shale mixed with sand. The first bit (s/n A74308) drilled 4973 feet in 93.5 hours with worn teeth, slight gage rounding, and erosion on the shirttail near the cutter. The next bit (s/n A73410) followed the previous bit and drilled 1971 feet in 83 hours with worn teeth, gage rounding and erosion on the shirttail near the cutter. The third bit (s/n A73409) drilled 1173 feet in 87 hours with slight erosion on all teeth. The fourth bit (s/n A73411) drilled 304 feet in 39.7 hours and reached total depth with a very green cutting structure; compared with offsets, the bit drilled further. The rig tried a PDC bit but pulled it for low ROP and went to the fourth bit. The PDC penetration rate was 6.5 ft/hr while the third bit before it was 13.5 ft/hr and the fourth bit was 7.7 ft/hr.

In Canada, the lithology was shale mixed with very abrasive sand. Bit (s/n W24220) was used for the build in a SAGD (Steam Assisted Gravity Drainage) pad and drilled 1339 feet in 89.3 hours on a motor. The cutting structure had worn teeth in all rows with gage rounding on the gage row teeth. Compared to offsets, the bit performed average in dull condition and had a competitive ROP.

Example D

The hardmetal composite of Example B was used on the teeth (both gage and inner row) of a 9½" drill bit. The drill bit was used to drill laterally through the sandstone reservoir of the Vincent development of the Northwestern Shelf in Australia. The bit completed a 501 m interval with an average ROP of 31.5 m/hr. The ROP is comparable to that insert type bits used in the same conditions; however, the drill bit of this example drilled a greater interval with improved wear resistance to the gage area and improved dull.

Example E

The hardmetal composites of Examples A and B were used on the teeth of a 12¼" drill bit, with the composite of Example A covering the inner row teeth and the composite of Example B covering the gage teeth. The bit was used to drill the Fiqa formation (of limestone and shale) in Fahud field in Oman. It was run on a positive displacement motor (1.5° bend). In its $4^{th}$ run, the bit drilled an interval of 153 m at an average ROP of 40.80 m/hr. The ROP was 44% better than competitor bits run in recently drilled offset wells, run on the same motor type under similar circumstances.

Example F

The hardmetal composites of Examples A and B were used on the teeth of another 12¼" drill bit, with the composite of Example A covering the inner row teeth and the composite of Example B covering the gage teeth. The bit was used for drilling in the Boulder Pinedale Anticline in Wyoming. The bit drilled an interval of 2500 ft at an average ROP of 147 ft/hr. The ROP was 39% higher than the offset average, the offsets being defined as all runs in the same hole size in the same field section within the twelve months prior to the run of the example bit.

Example G

The hardmetal composites of Examples A and B were used on the teeth of another 12¼" drill bit, with the composite of Example A covering the inner row teeth and the composite of Example B covering the gage teeth. The bit was used for drilling in the Riverside Pinedale Anticline in Wyoming. The bit drilled an interval of 2542 ft at an average ROP of 203 ft/hr. The ROP was 34% higher than the offset average, the offsets being defined as all runs in the same hole size in the same field section within the twelve months prior to the run of the example bit.

Example H

The hardmetal composite of Example B was used on the teeth (both gage and inner row) of a 12¼" drill bit. The bit was used for drilling in the Vible Pinedale Anticline in Wyoming. The bit drilled an interval of 2529 ft at an average ROP of 187 ft/hr. The ROP was 58% higher than the offset average, the offsets being defined as all runs in the same hole size in the same field section within the twelve months prior to the run of the example bit.

As used herein, the term "deformable constituent" refers to a hardphase constituent with characteristics such as low hardness, high binder content, and high residual porosity that give it plastic-like toughness and an ability to better absorb impacts.

The term "hardmetal composite" refers to a composite of a hardmetal such as tungsten carbide, diamond, cubic boron nitride, or ceramic dispersed in a softer, metal matrix, optionally including a binder metal as well. A hardmetal composite can be characterized by its wear resistance and toughness, and has a certain hardphase volume fraction.

The term "hardphase" as used herein can refer to either the entire hardphase of a hardmetal composite, that is, the entire hardmetal volume fraction. The term "hardphase" can also refer to an individual hardphase, in situations in which the hardmetal volume fraction is made up of more than one hardphase.

Depending on the context, all references herein to the "invention" may in some cases refer to certain specific embodiments only. In other cases it may refer to subject matter recited in one or more, but not necessarily all, of the claims. While the foregoing is directed to embodiments, versions and examples of the present invention, which are included to enable a person of ordinary skill in the art to make and use the inventions when the information in this patent is combined with available information and technology, the inventions are not limited to only these particular embodiments, versions and examples. Other and further embodiments, versions and examples of the invention may be devised without departing from the basic scope thereof and the scope thereof is determined by the claims that follow.

What is claimed is:

1. A hardmetal composite, comprising:

a solid state forged product of:

a primary hardphase;

at least one secondary hardphase, at least one of the primary hardphase and the at least one secondary hardphase having a particulate constituent having a residual porosity and which exhibits plastic deformation under pressure, and having at least 15% residual porosity; and a steel matrix comprised of iron powder;

wherein the particulate constituent of the at least one secondary hardphase has an average particle size smaller than an average particle size of the primary hardphase.

2. The composite of claim 1, wherein the primary hardphase has an average particle size of from 100 μm to 2000 μm.

3. The composite of claim 1, wherein the particulate constituent of the at least one secondary hardphase further comprises an average particle size of from 50 μm to 300 μm.

4. The composite of claim 1, wherein the particulate constituent of the at least one of the primary hardphase and the at least one secondary hardphase further comprises an average particle size of from 5 μm to 100 μm.

5. The composite of claim 3, wherein the particulate constituent of the at least one secondary hardphase further comprises a binder content greater than 10 wt %.

6. The composite of claim 3, wherein the at least one secondary hardphase further comprises a hardness less than 1500 VHN.

7. The composite of claim 1, wherein the primary hardphase comprises a Co binder and the at least one secondary hardphase further comprises a Ni binder.

8. The composite of claim 1, wherein a volume fraction of the primary hardphase plus a volume fraction of the at least one secondary hardphase is greater than 50 vol % of the solid state forged product.

9. The composite of claim 1, wherein a volume fraction of the primary hardphase plus a volume fraction of the at least one secondary hardphase is greater than 60 vol % of the solid state forged product.

10. The composite of claim 1, wherein the steel matrix is comprised of iron powder with an average particle size of less than 20 μm.

11. The composite of claim 10, wherein the steel matrix is in the form of a malleable shell encapsulating hard metal particles of the primary and at least one secondary hardphases to form encapsulated particles.

12. The composite of claim 11, wherein a malleable matrix volume is from 5% to 60% of each of the encapsulated particles.

13. The composite of claim 1, wherein the primary hardphase and the at least one secondary hardphase comprise a hardmetal chosen from the group consisting of carbide, diamond, cubic boron nitride, and ceramic.

14. The composite of claim 1 used as a surface for earth-engaging tools.

15. The composite of claim 1, wherein the primary hardphase further comprises from 3 to 16 wt % of a Co binder and a hardness of from 900 to 1800 VHN; the at least one secondary hardphase comprises the particulate constituent with an average particle size of from 10 to 60 μm, from 10 to 25 wt % of a Ni binder, and a hardness of from 800 to 1400 VHN; a volume fraction of the primary hardphase plus a volume fraction of the at least one secondary hardphase is greater than 70% of the solid state forged product.

16. An earth-engaging tool comprising hardsurfacing comprised of multiple carbide hard phases, comprising:

a primary hardphase;

at least one secondary hardphase, at least one of the primary hardphase and the at least one secondary hardphase having a particulate constituent having a residual porosity and which exhibits plastic deformation under pressure, and having at least 15% residual porosity; and a steel matrix comprised of iron powder;

wherein the particulate constituent of the at least one secondary hardphase has an average particle size smaller than an average particle size of the primary hardphase.

17. The tool of claim 16, wherein the hardsurfacing includes hardmetal particles with an average particle size of from 100 μm to 2000 μm.

18. The tool of claim 16, wherein the hardsurfacing has a hardphase volume fraction greater than 60%.

19. A method comprising:

selecting hardphases comprising:

a primary hardphase;

at least one secondary hardphase, at least one of the primary hardphase and the at least one secondary hardphase having a particulate constituent having a residual porosity and which exhibits plastic deformation under pressure, and having at least 15% residual porosity; and a steel matrix comprised of iron powder;

wherein the particulate constituent of the at least one secondary hardphase has an average particle size smaller than an average particle size of the primary hardphase;

encapsulating particles of said hardphases in a malleable matrix material to form a hardmetal composite, applying a desired amount of the encapsulated particles to the surface of a substrate; and finishing the substrate by forging.

20. The method of claim 19, wherein the hardmetal is carbide, one of the one or more hardphases has a particle size of from 100 μm to 2000 μm, and the total hardphase volume fraction is greater than 50%.

21. The method of claim 19, wherein the hardphases display bi-modal or multi-modal particle size distribution.

22. The method of claim 19, wherein the malleable matrix volume is from 5% to 60% of the encapsulated particles.

* * * * *